US010876234B2

(12) United States Patent
Herrlich et al.

(10) Patent No.: US 10,876,234 B2
(45) Date of Patent: Dec. 29, 2020

(54) VOLUME NONWOVEN FABRIC

(71) Applicant: Carl Freudenberg KG, Weinheim (DE)

(72) Inventors: Ulrike Herrlich, Bammental (DE); Gunter Scharfenberger, Frankenthal (DE); Thomas Sattler, Wald-Michelbach (DE); Peter Grynaeus, Birkenau (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 15/751,491

(22) PCT Filed: Aug. 11, 2016

(86) PCT No.: PCT/EP2016/069151
§ 371 (c)(1),
(2) Date: Feb. 9, 2018

(87) PCT Pub. No.: WO2017/029191
PCT Pub. Date: Feb. 23, 2017

(65) Prior Publication Data

US 2018/0230630 A1 Aug. 16, 2018

(30) Foreign Application Priority Data

Aug. 18, 2015 (EP) ..... 15181388

(51) Int. Cl.

| | |
|---|---|
| ***D04H 1/732*** | (2012.01) |
| ***D04H 1/02*** | (2006.01) |
| ***D04H 1/54*** | (2012.01) |
| ***D04H 1/70*** | (2012.01) |
| ***D04H 1/72*** | (2012.01) |
| ***D04H 1/42*** | (2012.01) |
| ***D04H 1/558*** | (2012.01) |
| ***D04H 1/00*** | (2006.01) |
| ***A47G 9/08*** | (2006.01) |
| ***A47G 9/10*** | (2006.01) |
| ***A47G 9/02*** | (2006.01) |

(52) U.S. Cl.
CPC ..... *D04H 1/732* (2013.01); *D04H 1/00* (2013.01); *D04H 1/02* (2013.01); *D04H 1/42* (2013.01); *D04H 1/54* (2013.01); *D04H 1/558* (2013.01); *D04H 1/70* (2013.01); *D04H 1/72* (2013.01); *A47G 9/02* (2013.01); *A47G 9/08* (2013.01); *A47G 9/10* (2013.01)

(58) Field of Classification Search
USPC .... 264/15, 110, 117, 121–122; 428/85, 218, 428/220, 369; 442/327, 361, 415
See application file for complete search history.

(56) References Cited

U.S. PATENT DOCUMENTS

| | | | | |
|---|---|---|---|---|
| 4,618,531 | A * | 10/1986 | Marcus | D04H 1/4391 428/369 |
| 4,820,574 | A | 4/1989 | Tesch | |
| 5,618,364 | A | 4/1997 | Kwok | |
| 2003/0162020 | A1 | 8/2003 | Rumiesz et al. | |
| 2009/0253323 | A1 | 10/2009 | Mueller et al. | |
| 2011/0089593 | A1 | 4/2011 | Miyauchi et al. | |
| 2016/0355958 | A1 | 12/2016 | Grynaeus et al. | |
| 2017/0362755 | A1* | 12/2017 | Mason | D04H 1/02 |

FOREIGN PATENT DOCUMENTS

| | | | |
|---|---|---|---|
| CN | 2832859 | Y | 11/2006 |
| EP | 0203469 | A | 12/1986 |
| EP | 0268099 | A1 | 5/1988 |
| EP | 0257658 | B1 | 4/1991 |
| EP | 0906981 | A1 | 4/1999 |
| JP | S 5868196 | U | 5/1983 |
| JP | H 04146250 | A | 5/1992 |
| KR | 20120131673 | A | 12/2012 |
| RU | 2272855 | C2 | 3/2006 |
| RU | 93404 | U1 | 4/2010 |
| RU | 2485229 | C2 | 6/2013 |
| TW | 360727 | B | 6/1999 |
| TW | 464706 | B | 11/2001 |
| TW | 552330 | B | 9/2003 |
| TW | I 374206 | B | 10/2012 |
| WO | WO 9114035 | A1 | 9/1991 |
| WO | WO 9114035 | A1 | 9/1999 |
| WO | WO 03057962 | A2 | 7/2003 |
| WO | WO 2005044529 | A1 | 5/2005 |
| WO | WO 2012006300 | A1 | 1/2012 |
| WO | WO 2015124548 | A1 | 8/2015 |

* cited by examiner

*Primary Examiner* — Lynda Salvatore
(74) *Attorney, Agent, or Firm* — Leydig, Voit & Mayer, Ltd.

(57) ABSTRACT

A method for producing a volume nonwoven fabric includes the steps of: (a) providing a nonwoven fabric raw material, containing fiber balls and binder fibers; (b) providing an air-laying device, which has at least two spiked rollers between which a gap is formed; (c) processing the nonwoven fabric raw material in the device in an air-laying method, the nonwoven fabric raw material passing through the gap between the spiked rollers, fibers or fiber bundles being pulled from the fiber balls by the spikes; (d) laying on a laying apparatus; and (e) thermally bonding so as to obtain the volume nonwoven fabric.

22 Claims, No Drawings

VOLUME NONWOVEN FABRIC

CROSS-REFERENCE TO PRIOR APPLICATIONS

This application is a U.S. National Phase application under 35 U.S.C. § 371 of International Application No. PCT/EP2016/069151, filed on Aug. 11, 2016, and claims benefit to European Patent Application No. EP 15181388.8, filed on Aug. 18, 2015. The International Application was published in German on Feb. 23, 2017 as WO 2017/029191 under PCT Article 21(2).

FIELD

The invention relates to a method for producing a volume nonwoven fabric, to the volume nonwoven fabrics obtainable by the method and to the uses thereof.

BACKGROUND

Various padding materials for textile applications are known. For example, small feathers, downs and animal hair, such as wool, have long been used for padding blankets and garments. Padding materials made of downs are very pleasant in use, since they combine very good thermal insulation with a low weight. However, a drawback of these materials is that they only have low cohesion with one another.

An alternative to the use of downs and animal hairs is the use of fiber nonwovens or nonwoven fabrics as a padding material. Nonwoven fabrics are structures of fibers of limited length (staple fibers), filaments (endless fibers) or cut yarns of any type and any origin, which are combined in some manner to form a nonwoven (a web) and have been interconnected in some manner. A drawback of conventional fiber nonwovens or nonwoven fabrics is that they have a lower fleeciness than voluminous padding materials such as downs. In addition, over a relatively long period of use, the thickness of conventional nonwoven fabrics becomes thinner and thinner.

Fiber balls are an alternative to the use of padding materials of this type. Fiber balls contain fibers which are wound together more or less spherically and which are usually approximately in the form of a ball. For example, EP 0 203 469 A describes fiber balls which can be used as padding or cushion material. These fiber balls consist of spiral-crimped polyester fibers which are wound together and which have a length of approximately 10 to 60 mm and a diameter of between 1 and 15 mm. The fiber balls are resilient and thermally insulating. A drawback of the fiber balls is that, like downs, feathers, animal hairs or the like, they only have a low cohesion with one another. Fiber balls of this type are therefore only poorly suited as padding materials for flat textile materials in which the fiber balls are to be provided loose, since they can slip as a result of their low adhesion. To prevent slipping in the flat textile materials, they are often quilted.

To improve the connection of fiber balls, EP 0 257 658 B1 proposes using fiber balls having protruding fiber ends, which may also have hooks. However, the production of materials of this type is relatively complex, and the fiber ends can kink or bend during transport, storage and processing.

WO 91/14035 proposes thermally bonding a nonwoven fabric raw material of fiber balls and binder fibers into layers and subsequently needling them. In this context, the nonwoven fabric raw materials are guided in an airflow to a single spiked roller and laid on a belt thereby. A drawback of the products is that without needling the stability is low, since the binder fibers can only slightly stabilize the voluminous, loose fiber balls. To achieve sufficient stability, needling is carried out, complicating the method and undesirably increasing the density of the product.

EP 0 268 099 discloses methods for producing fiber balls having modified surfaces. In this context, the surface of the fiber balls can be furnished with binder fibers. Composites can be produced from the fiber balls by heating. The production of the fiber balls is relatively complex. Since the fiber balls are only connected to the surface using binder fibers, the stability of the composite materials is limited. Because of the flat binding points, further product properties such as fleeciness and resilience are also in need of improvement.

WO 2012/006300 discloses nonwoven fabrics which comprise binder fibers and are thermally bonded in connection regions. The nonwoven fabrics may contain solid additives in particulate form (pages 20 to 28). The additives are relatively hard solids, such as abrasives or porous foams. According to the embodiments, solid particles are added, which can be produced in advance by grinding sponges in a hammer mill. The document does not relate to the production of textile padding materials or other volume materials having high fleeciness.

WO 2005/044529 A1 describes devices by means of which various substances can be homogenized in an aerodynamic method. In this context, the raw materials go past rotating spiked rollers. The method may for example be used for processing cellulose fibers, synthetic fibers, pieces of metal, plastics material parts or granulates. Relatively harsh methods of this type are used in waste management, among other things.

SUMMARY

In an embodiment, the present invention provides a method for producing a volume nonwoven fabric, comprising the steps of: (a) providing a nonwoven fabric raw material, containing fiber balls and binder fibers; (b) providing an air-laying device, which has at least two spiked rollers between which a gap is formed; (c) processing the nonwoven fabric raw material in the device in an air-laying method, the nonwoven fabric raw material passing through the gap between the spiked rollers, fibers or fiber bundles being pulled from the fiber balls by the spikes; (d) laying on a laying apparatus; and (e) thermally bonding so as to obtain the volume nonwoven fabric.

DETAILED DESCRIPTION

In an embodiment, an object of the invention is to provide a volume nonwoven fabric and a method for the production thereof which combine several advantageous properties. The nonwoven fabric should in particular be voluminous and have a low density, and at the same time have high stability, in particular a good tensile strength. It should combine a good thermal insulation capacity with high softness, high compressive resilience, low weight and good fitting to a body to be enveloped. At the same time, the nonwoven fabric should have sufficient wash stability and mechanical stability to be treatable for example as web material. In particular, the nonwoven fabric should be cuttable and rollable. The nonwoven fabric should be suitable for textile applications.

One subject matter of the invention is a method for producing a nonwoven fabric, comprising the steps of:

(a) providing a nonwoven fabric raw material, containing fiber balls and binder fibers, (b) providing an air-laying device, which has at least two spiked rollers between which at least one gap is formed, (c) processing the nonwoven fabric raw material in the device in an air-laying method, the nonwoven fabric raw material passing through the gap between the spiked rollers, fibers or fiber bundles being pulled from the fiber balls by the spikes, (d) laying on a laying apparatus, and (e) thermally bonding so as to obtain the volume nonwoven fabric.

The steps are carried out in the sequence (a) to (e).

A volume nonwoven fabric refers generally to a nonwoven fabric product having a relatively low density. In step (a), a nonwoven fabric raw material is used. The term "raw material" refers to a mixture of the components which are to be processed together to form the volume nonwoven fabric. The raw material is a loose mixture; in other words, the components have not been interconnected, in particular not having been thermally connected, needled, glued or subjected to other similar methods in which a deliberate chemical or physical bond is generated.

The nonwoven raw material in step (a) contains fiber balls. Fiber balls are widely known in the technical field, and are used as padding materials. These are relatively small and light fiber agglomerates which are readily separable from one another. The structure and shape may vary depending on the materials used and the desired properties of the volume nonwoven fabric. In particular, the term "fiber balls" is intended to mean both ball shapes and approximate ball shapes, for example irregular and/or deformed, for example flattened or elongated ball shapes. It has been found that ball shapes and approximate ball shapes have particularly good properties as regards fleeciness and thermal insulation. Methods for producing fiber balls are known in the art, and are described for example in EP 0 203 469 A.

The fibers can be relatively uniformly distributed in a fiber ball, it being possible for the density to decrease towards the outside. In this context, it is conceivable for example for there to be a uniform distribution of the fibers within the fiber balls and/or for there to be a fiber gradient. Alternatively, the fibers may be arranged substantially in a spherical shell, whilst relatively few fibers are arranged in the center of the fiber balls.

It is also conceivable for the fiber balls to contain spherically wound and/or fuzzily formed fibers. To ensure good cohesion of the aggregate, it is advantageous for the fibers to be in a crimped form. In this context, the fibers may either be unordered or have a degree of ordering.

In one embodiment, the fibers are arranged randomly in the interior of the individual fiber balls and spherically in an outer layer of the fiber balls. In this configuration, the outer layer is relatively small by comparison with the diameter of the fiber balls. As a result, the softness of the fiber balls can be improved even more.

The type of the fibers present in the fiber balls is in principle not critical, as long as they are suitable for forming fiber balls, for example as a result of a suitable surface structure and fiber length. Preferably, the fibers of the fiber balls are selected from the group consisting of staple fibers, filaments and/or yarns. In this context, unlike filaments, which are of theoretically unlimited length, staple fibers are understood to mean fibers having a limited length, preferably of 20 mm to 200 mm. The filaments and/or yarns are preferably also of a limited length, in particular of 20 mm to 200 mm. The filaments may be in the form of monocomponent filaments and/or composite filaments. The titer of the fibers can also vary. Preferably, the average titer of the fibers is in the range of 0.1 to 10 dtex, preferably of 0.5-7.5 dtex.

It is particularly preferred for the fiber balls used not to be thermally pre-bonded. As a result, a particularly soft and voluminous volume nonwoven fabric can be obtained.

Surprisingly, it has been found that an advantageous volume nonwoven fabric can be obtained if a volumizing nonwoven fabric raw material containing fiber balls and binder fibers is processed using spiked rollers in an air-laying method. It has thus been found that when the mixture is processed between spiked rollers in an air-laying method, efficient opening, mixing and orientation of the nonwoven raw material is achieved without the material being completely destroyed in the process. This was surprising because fiber balls used as a raw material, for example, are extremely delicate, and so it was assumed that they would be destroyed in a process of this type, detracting from the stability and functionality of the end product. It was not predictable whether fiber balls could even be processed using devices comprising spiked rollers, which are actually used for destroying structures.

Preferably, the spiked rollers are arranged in the device in pairs, in such a way that the metal spikes can mesh in one another. The meshing of the metal spikes results in a dynamic sieve, as a result of which the nonwoven fabric raw materials can be individuated and uniformly distributed. Further, in the case of the fiber balls, treatment using spiked rollers arranged in pairs can lead to loosening of the fiber structure without destroying the ball shape as a whole. In this context, fibers or fiber bundles can be pulled out of the balls in such a way that they are still connected to the fiber ball but protrude from the surface. This is advantageous because the fibers which are pulled out hook the individual balls to one another and thus increase the tensile strength of the volume nonwoven fabric. Further, a matrix of individual fibers in which the balls are embedded can be formed, increasing the softness of the volume nonwoven fabric.

At the same time, the method has the advantage that the binder fibers are very tightly connected to the nonwoven fabric balls. It is assumed that some of the binder fibers are also introduced into the fiber balls by the spikes. The two materials thus penetrate one another. During thermal bonding, this significantly increases the proportion of adhesion points between the fiber balls and the binder fibers. For this reason too, the nonwoven fabrics have exceptionally high stability. Thus, the nonwoven fabric according to the invention is much more stable than products from conventional methods, in which fiber balls are merely opened or carded and subsequently mixed with binder fibers.

Among other things, the particular properties of the product are obtained because the method is carried out as an air-laying method. The term "air-laying method" (aerodynamic method) refers to the fact that the nonwoven fabric raw material containing fiber balls and binder fibers is processed by means of the spiked rollers and laid in the air flow. The nonwoven fabric raw material is thus guided in the airflow to the spiked rollers and processed thereby. This has the advantage that the nonwoven fabric raw material remains in a loose, voluminous form during processing by means of the spiked rollers, but is still intensively mixed, the spikes penetrating through the nonwoven balls. The method thus differs significantly from conventional methods, in which webs of nonwoven fabric raw material are carded. In carding methods of this type, the nonwoven fabric raw materials are substantially orientated. Because the web material is unmovable, mixing, opening and mutual penetration of the components are not achieved as in the air-laying method according to the invention, in which the nonwoven fabric raw material passes the spiked rollers in a loose form in the airflow. Thus, according to the invention, a product can be obtained of which the density is even lower than that of the fiber balls used.

It was possible to establish that the method makes highly uniform distribution of the raw material on the laying belt possible and a highly homogeneous volume nonwoven fabric can be achieved in which the volumizing material is uniformly distributed. The homogeneous distribution of the volumizing material is highly advantageous particularly as regards the thermal insulation capacity and softness and for the recovery of the volume nonwoven fabric.

According to the invention, a highly homogeneous volume nonwoven fabric can be obtained. The fiber balls and binder fibers can be mixed internally and are in a highly homogeneous and uniformly distributed form. This was surprising because it had to be assumed that the delicate fiber balls, as well as other delicate components such as downs, would be destroyed during treatment using spiked rollers.

Nevertheless, the structure of the individual fiber balls in the volume nonwoven fabric is non-uniform. The fiber balls in the nonwoven fabric have lost the original form thereof at least in part. The structure of the fiber balls in the volume nonwoven fabric could be described as frayed, partially disintegrated or partially destroyed. The spiked rollers act on each individual fiber ball randomly and thus differently. Therefore, the number, size and structure of the regions at which fibers or fiber bundles are pulled out of the fiber balls, or in which binder fibers are pulled into the fiber balls, are randomly distributed. Thus, in the nonwoven fabric, round fiber balls used as starting materials form structures which could be described very approximately as star-shaped with irregular points. It is assumed that specifically the internal mixing of the disintegrated fiber balls with the binder fibers leads to a broad distribution of the binding points of the binder fibers in the product, giving the nonwoven fabric the surprisingly high mechanical stability. At the same time, the fiber balls give the product a low density and a high softness and fleeciness. The structure differs significantly from known nonwoven fabrics made of fiber balls and fibers, which are produced simply by mixing without disintegration of the fiber balls. Nonwoven fabrics of this type have defined bonded regions, and this leads to lower softness because of the more strongly bonded regions and lower stability because of the non-bonded regions.

Practical tests have shown that particularly good results are obtained when using the method according to the invention if it comprises one or more of the following steps.

The nonwoven fabric raw material is laid as uniformly as possible in the air-laying device, comprising at least one pair of spiked rollers, in which the components are opened and mixed together. Subsequently, the fiber laying for nonwoven formation can take place in a conventional manner, for example on a filter belt, a screen drum and/or a transport belt. The nonwoven formed can thereupon be bonded in a conventional manner. According to the invention, thermal bonding, for example using a conveyor furnace, has been found to be particularly suitable. This exploits the fact that the binder fibers are tightly connected to the fiber balls. Undesired compression of the volume nonwoven fabric, such as would take place for example during water jet bonding or needling, can also be prevented. The use of a double-belt convection furnace has been found to be particularly suitable. An advantage of the use of a convection furnace of this type is that particularly effective activation of the binder fibers can be obtained whilst simultaneously smoothing the surface and obtaining the volume.

In an advantageous embodiment of the invention, the spiked rollers are arranged in rows. The spiked rollers are thus advantageously arranged in at least one row. An advantage of arranging the spiked rollers in at least one row is that the metal spikes of the adjacent spiked rollers can mesh in one another. Thus, each roller can simultaneously form a pair, which can act as a dynamic sieve, with each of the rollers adjacent thereto. These rows may also be present in pairs (double rows) so as to obtain particularly good opening and mixing of the fibers and fiber balls. The spiked rollers are thus advantageously arranged in at least one double row. It is also conceivable for at least part of the fiber material to be guided through the same spiked rollers more than once by means of a feedback system. For example, a circulating endless belt or aerodynamic means, such as pipes which blow the material upwards, may be used for the feedback. The belt may advantageously be arranged between two rows of spiked rollers. Further, the endless belt may also be guided by a plurality of double rows of spiked rollers arranged in succession or above one another.

The device comprises spiked rollers. During the rotation of two opposing rollers which form a gap for nonwoven fabric raw material to pass through, the spikes preferably mesh together in an offset manner. The spikes preferably have a thin, elongate shape. The spikes are sufficiently long to achieve good penetration of the materials and of the fiber balls. The length of the spikes is preferably between 1 and 30 cm, in particular between 2 and 20 cm or between 5 and 15 cm. In this context, the length of the spikes may be at least 5 or at least 10 times as great as the widest diameter of the spikes.

The gaps between the spiked rollers, through which the nonwoven fabric raw material passes, are preferably sufficiently wide that the nonwoven fabric raw material is not compressed during passage. As a result of the nonwoven fabric balls opening, the material is instead loosened up. Preferably, the spikes on each of the two sides are of a length corresponding to more than 50%, preferably at least 60%, at least 70% or at least 80% of the (narrowest) width of the gap. Preferably, the spikes on each of the two sides are of a length corresponding to more than 50% to 99% or 60% to 95% of the (narrowest) width of the gap.

Preferably, the device has at least two pairs, preferably at least 5 pairs or at least 10 pairs, of spiked rollers, and/or the device preferably has at least 2, at least 5 or at least 10 gaps between the spiked rollers. The nonwoven fabric raw material can be processed particularly efficiently using devices of this type.

The device is preferably configured in such a way that the contact area of the spiked rollers with the nonwoven fabric raw material is as large as possible. Preferably, a plurality of spiked rollers are present, for example at least 5, at least 10 or at least 20 spiked rollers. Preferably, there are at least 5, at least 10 or at least 20 gaps between adjacent roller pairs through which the nonwoven fabric raw material can pass. The rollers may for example be formed cylindrical. Conventionally, the cylindrical rollers are rigidly connected to the spikes in this context. It is also conceivable to equip a roller core with circulating spiked belts. Preferably there are a plurality of levels, in such a way that the material is processed more than once.

For opening the fiber raw material, the device could have 2 to 10 rows, arranged in pairs and comprising 2 to 10 spiked rollers each. In this context, it could have four rows, arranged in two pairs and comprising five spiked rollers each. Air-laying devices of this type are available for example under the brand name "SPIKE" air-laying system from Formfiber Denmark APS. The method is an air-laying method, in other words an aerodynamic nonwoven formation process; in other words, the nonwoven is formed with the assistance of air. The basic principle of this method involves passing the nonwoven fabric raw material into an airflow, which makes possible mechanical distribution of the nonwoven fabric raw material in the longitudinal and/or transverse machine direction and finally homogeneous laying of the nonwoven fabric raw material on a suction transport belt.

In this context, air can be used in a wide range of method steps. In a particularly preferred embodiment of the invention, the entire transportation of the nonwoven raw material during the nonwoven formation takes place aerodynamically, for example by means of an installed air system. However, it is likewise conceivable for only specific method steps, for example removing the fibers from the spiked rollers, to be supported using additional air.

On the basis of practical tests, the air-laying method is carried out in particular with one or more of the following steps.

Expediently, the processes of nonwoven fabric raw material preparation and nonwoven fabric raw material disintegration are directly upstream from the nonwoven formation process. The optional mixing with non-fiber materials, for example downs and/or foamed material parts, preferably takes place directly during the distribution of the fiber material in the nonwoven formation system.

With the assistance of air as a transport medium, the material (the nonwoven fabric raw material or the components thereof) can be transported into the nonwoven formation unit, where targeted opening and swirling and simultaneously homogeneous mixing and distribution take place, via a supply and distribution system. So as to be able to control the material supply in a simple manner, each material component is advantageously supplied separately.

Subsequently, the nonwoven fabric raw material is preferably treated using at least two spiked rollers, by means of which the fiber material is prepared or disintegrated. Particularly good results are achieved if the nonwoven fabric raw material is passed through a row of rotating shafts equipped with metal spikes, as spiked rollers. In a preferred embodiment, the adjacent spiked rollers rotate in opposite directions. As a result, particularly high forces can act on the nonwoven fabric raw material. The meshing together of the metal spikes results in a dynamic sieve which makes high throughput amounts possible. The method thus differs significantly from a method as in WO 91/14035, in which nonwoven fabric raw material is only guided and laid by a single spiked roller. In this context, forces cannot act on the material with the associated structural changes as in the method according to the invention.

Advantageously, the nonwoven formation takes place on a suction filter belt. On the filter belt, a random nonwoven structure without a pronounced fiber orientation can be produced, the density of which is related to the intensity of the suction. As a result of the arrangement of a plurality of nonwoven formation units in a line, a layer construction can be implemented.

An advantage of the aerodynamic nonwoven formation is that the fibers and the optionally present further components in the nonwoven fabric raw material can be arranged in a random layer which makes very high property isotropy possible. Aside from the structural aspects, this embodiment also has economic advantages resulting from the level of investment and the operating costs for the production systems.

In an embodiment of the invention, the nonwoven formation takes place in a plurality of nonwoven formation units arranged in succession. It is thus conceivable that a laying belt, for example a suction filter belt, is passed through a plurality of nonwoven formation units in succession, in each of which a layer of a nonwoven is laid. As a result, a multilayer nonwoven can be produced.

In a further step (e) the nonwoven is thermally bonded. Preferably, no pressure is exerted on the nonwoven fabric in this context. For example, thermal bonding without exertion of pressure can take place in a furnace. This has the advantage that the nonwoven fabric is highly voluminous even though it has a high strength. The nonwoven bonding can be assisted in a conventional manner, for example chemically by spraying with binder, thermally by melting adhesive powder added in advance, and/or mechanically, for example by needling and/or water jet bonding.

Practical tests have shown that the nonwoven formation may preferably be carried out using a device for producing a fiber nonwoven as described in WO 2005/044529, with very good results. Reference is hereby explicitly made to the advantageous embodiments of the device disclosed therein on page 2, line 25 to page 4, line 9, on page 4, line 15 to page 5, line 9, and on page 6, line 22 to page 7, line 19.

In a preferred embodiment, the proportion of fiber balls is 50 to 95% by weight, preferably 60 to 95%, in particular 70 to 90%, and/or the proportion of binder fibers in the volume nonwoven fabric is 5 to 40% by weight, preferably 7 to 30% by weight and particularly preferably 10 to 25% by weight, in each case based on the total weight of the nonwoven fabric raw material.

The fiber balls contain or preferably consist of fibers selected from artificial polymers, in particular fibers made of polyester, in particular polyethylene terephthalate, polyethylene naphthalate and polybutylene terephthalate; and natural fibers, in particular wool, cotton or silk fibers, and/or mixtures thereof and/or mixtures with other fibers.

In principle, the fiber balls may consist of a wide range of fibers. Thus, the fiber balls may comprise and/or consist of natural fibers, for example wool fibers and/or synthetic fibers, for example fibers made of polyacryl, polyacrylnitrile, peroxidised PAN, PPS, carbon, glass, polyvinyl alcohol, viscose wool, cellulose wool, cotton, polyaramids, polyamide imide, polyamides, in particular polyamide 6 and polyamide 6.6, PULP, preferably polyolefins and particularly preferably polyester, in particular polyethylene terephthalate, polyethylene naphthalate and polybutylene terephthalate, and/or mixtures of the above. In a preferred embodiment, fiber balls made of wool fibers are used. In this context, particularly dimensionally stable and well-insulating volume nonwoven fabrics can be obtained. In a further preferred embodiment, fiber balls made of polyester are used, so as to achieve particularly good compatibility with the conventional further components within the volume nonwoven fabric or in a nonwoven fabric composite. In a preferred embodiment, the fiber balls additionally themselves contain binder fibers, which are preferably of a length of 0.5 mm to 100 mm.

In addition to the fiber balls, the nonwoven fabric raw material in step (a) contains binder fibers. These binder fibers are loose fibers, and not a component of the fiber balls. In a preferred embodiment, these binder fibers are configured as core/sheath fibers, the sheath comprising polybutylene terephthalate, polyamide, copolyamides, copolyester or polyolefins, such as polyethylene or polypropylene, and/or the core comprising polyethylene terephthalate, polyethylene naphthalate, polyolefins, such as polyethylene or polypropylene, polyphenylene sulphide, aromatic polyamides and/or polyester. The melting point of the sheath polymer is conventionally higher than that of the core polymer, for example by more than 10° C.

The fibers conventionally used for this purpose may be used as binder fibers. Binder fibers may be unitary fibers or else multicomponent fibers. Binder fibers which are particularly suitable according to the invention are fibers of the following groups:

fibers having a melting point below the melting point of the volumizing material to be bound, preferably below 250° C., in particular of 70 to 230° C., particular preferably of 125 to 200° C. Suitable fibers are in particular thermoplastic polyester and/or copolyester, in particular PBT, polyolefins, in particular polypropylene, polyamides, polyvinyl alcohol, or else copolymers, as well as the copolymers and mixtures thereof;

adhesive fibers, such as non-orientated polyester fibers.

Binder fibers which are particularly suitable according to the invention are multicomponent fibers, preferably bicomponent fibers, in particular core/sheath fibers. Core/sheath fibers contain at least two fiber materials having a different softening and/or melting temperature. Preferably, core/sheath fibers consist of these two fiber materials. In this context, the component having the lower softening and/or melting temperature is located on the fiber surface (sheath) and the component having the higher softening and/or melting temperature is located in the core.

In core/sheath fibers, the binding functionality may be carried out by the materials arranged on the surface of the fibers. A wide range of materials may be used for the sheath. According to the invention, preferred materials for the sheath are PBT, PA, polyethylene, copolyamides or else copolyester. Polyethylene is particularly preferred. A wide range of materials may likewise be used for the core. According to the invention, preferred materials for the core are PET, PEN, PO, PPS or aromatic PA and PES.

An advantage of the presence of binder fibers is that the volumizing material in the volume nonwoven fabric is held together by the binder fibers, in such a way that a textile envelope, filled with the volume nonwoven fabric, can be used without the volumizing material being substantially displaced and cold bridges forming as a result of lacking padding material.

Preferably, the binder fibers are of a length of 0.5 mm to 100 mm, more preferably of 1 mm to 75 mm, and/or a titer of 0.5 to 10 dtex. In a preferred embodiment of the invention, the binder fibers are of a titer of 0.9 to 7 dtex, more preferably of 1.0 to 6.7 dtex, and in particular of 1.3 to 3.3 dtex.

The proportion of binder fibers in the volume nonwoven fabric is set as a function of the type and amount of the further components of the volume nonwoven fabric and the desired stability of the volume nonwoven fabric. If the proportion of binder fibers is too low, the stability of the volume nonwoven fabric is worsened. If the proportion of binder fibers is too high, the volume nonwoven material becomes too solid overall, detracting from the softness thereof. Practical tests have shown that a good compromise between stability and softness is obtained if the proportion of binder fibers is in the range of 5 to 40% by weight, preferably 7 to 30% by weight and particularly preferably 10 to 25% by weight. In this case, a volume nonwoven material can be obtained which is stable enough to be rolled and/or folded. This means that the volume nonwoven fabric can be treated and further processed more easily. Further, a volume nonwoven fabric of this type is washable. For example, it is stable enough to withstand three domestic washes at 40° C. without disintegration.

The binder fibers can be interconnected and/or connected to the further components of the volume nonwoven fabric by thermofusion. Hot calendering using heated, smooth or engraved rollers, by drawing through a convection tunnel furnace, convection double-belt furnace and/or by drawing onto a drum flowed through by hot air, has been found to be particularly effective. An advantage of the use of a double-belt convention furnace is that the binder fibers can be particularly effectively activated while simultaneously smoothing the surface while simultaneously obtaining the volume.

In addition, the volume nonwoven fabric may also be bonded in that fluid jets, preferably water jets, are applied at least once to each side of the optionally pre-bonded web.

In a preferred embodiment, the mixture contains at least one further component which is not a fiber ball or binder fibers. The total proportion of further components of this type is preferably up to 45% by weight, up to 30% by weight, up to 20% by weight or up to 10% by weight.

Preferably, further components of this type are selected from further fibers, further volumizing materials and other functional additives.

In one embodiment, further fibers which are not binder fibers are contained as further components. Fibers of this type can furnish the nonwoven fabrics with particular properties, such as softness, optical properties, fire resistance, tear resistance, conductivity, water management or the like. Since these fibers are not in the form of fiber balls, they can have a wide range of surface constitutions, and in particular may also be smooth fibers. Thus for example silk fibers may be used as further fibers so as to furnish the volume nonwoven fabric with a particular luster. The use of polyacryl, polyacrylnitrile, peroxidised PAN, PPS, carbon fibers, glass fibers, polyaramids, polyamide imide, melamine resin, phenol resin, polyvinyl alcohol, polyamides, in particular polyamide 6 and polyamide 6.6, polyolefins, viscose, cellulose, and preferably polyester, in particular polyethylene terephthalate, polyethylene naphthalate and polybutylene terephthalate, and/or mixtures thereof is also conceivable. Preferably, the proportion of the further fibers in the volume nonwoven fabric is from 2 to 40% by weight, in particular from 5 to 30% by weight. Preferably, the further fibers are of a length of 1 to 200 mm, preferably of 5 to 100 mm, and/or a titer of 0.5 to 20 dtex.

In one embodiment, further volumizing materials which are not fiber balls are contained as a further component, in particular downs, small feathers or foamed material particles. The further materials can influence the density and furnish the material with different desired properties. The use of downs or small feathers is particularly preferred in textile applications in particular in the field of clothing, and can improve the thermal properties. If according to the invention downs and/or small feathers are used as a volumizing material, the proportion thereof in the volume nonwoven fabric is for example 10 to 45% by weight, preferably 15 to 45% or at least 15% by weight. According to the invention, the term downs and/or small feathers is understood within the conventional meaning. In particular, downs and/or small feathers are understood as feathers having a short stem and very soft and long radially arranged feather limbs substantially without barbs.

In one embodiment, further functional materials, which are not fibers or volumizing materials, are contained as further components. In the technical field, numerous additives of this type are known, such as dyes, antibacterial substances or odorants. In a preferred embodiment, the volume nonwoven fabric contains a phase-change material. Phase change materials (PCMs) are materials of which the latent heat of fusion, heat of solution or heat of absorption is much greater than the heat which they can store by virtue of the normal specific heat capacity thereof (without the phase change effect). The phase change material can be contained in the material composite in a particle form and/or fiber-like form and for example be connected to the rest of the components of the volume nonwoven material via the binder fibers. The presence of the phase change material can support the insulation effect of the volume nonwoven material.

The polymers used for producing the fibers of the volume nonwoven material may contain at least one additive, selected from the group consisting of color pigments, antistatic agents, antimicrobials such as copper, silver, gold, or hydrophilic or hydrophobic additives in an amount of 150 ppm to 10% by weight. The use of said additives in the polymers used makes adaptation to customer-specific requirements possible.

In a preferred embodiment, the density of the volume nonwoven fabric is at least 5%, preferably at least 10%, more preferably at least 25% lower than the density of the nonwoven fabric balls used in step (a). This is advantageous because a particularly voluminous nonwoven fabric is obtained, which nevertheless has very high stability.

In a preferred embodiment, the method is carried out in such a way that the volume nonwoven fabric obtained in step (e) is not mechanically bonded. This is advantageous because a product with a very low density is obtained.

In particular, in the method of steps (a) to (e), no needling, water jet bonding and/or calendering takes place. Surprisingly, the highly voluminous nonwoven fabrics of the invention are highly stable even without additional method steps of this type and in spite of the low density. Preferably, the nonwoven fabric raw materials are also not carded.

After the thermal bonding in step (e), the volume nonwoven fabric may be subjected to chemical bonding or refinement, such as an anti-pilling treatment, hydrophilization or hydrophobization, an antistatic treatment, a treatment to improve the fire resistance and/or to alter the tactile properties or the luster, a mechanical treatment such as roughening, sanforization, sanding or a treatment in a tumbler and/or a treatment to alter the appearance such as dying or printing.

The volume nonwoven fabric according to the invention may contain further layers, resulting in a nonwoven fabric composite being formed. In this context, it is conceivable for the further layers to be formed as reinforcement layers, for example in the form of a scrim, and/or to comprise reinforcing filaments, nonwoven fabrics, wovens, stitch fabrics and/or rovings. Preferred materials for forming the further layers are plastics materials, for example polyester, and/or metals. In this context, the further layers may advantageously be arranged on the surface of the volume nonwoven fabric. In a preferred embodiment of the invention, the further layers are arranged on both surfaces (upper and lower face) of the volume nonwoven fabric.

The volume nonwoven fabric according to the invention is excellently suited for the production of a wide range of textile products, in particular products which are to be light, stable and also thermophysiologically comfortable. Therefore, a further subject matter of the invention is a method for producing a textile material comprising producing a volume nonwoven fabric in a method according to the invention and further processing to form the textile material.

The textile material is in particular selected from garments, molding materials, cushion materials, padding materials, bedding, filter mats, suction mats, cleaning textiles, spacers, foam substitute, wound dressings and fire protection materials.

The volume nonwoven fabric may therefore in particular be used as a molding material, cushion material and/or padding material, in particular for clothing. However, the molding materials, cushion materials and/or padding materials are also suitable for other applications, for example for furniture for sitting and lying on, cushions, cushion covers, duvets, mattress covers, sleeping bags, mattresses, mattress toppers.

According to the invention, the term garment is used within the conventional meaning, and preferably comprises fashion, casual, sport, outdoor and functional clothing, in particular outer clothing such as jackets, coats, cardigans, trousers, overalls, gloves, caps and/or shoes. Because of the good thermal insulation properties of the volume nonwoven fabric contained therein, garments which are particularly preferred according to the invention are thermally insulating garments, for example jackets and coats for all seasons, in particular winter jackets, winter coats and winter cardigans, ski and snowboarding jackets, trousers and overalls, thermal jackets, coats and cardigans, ski and snowboarding gloves, winter caps, thermal caps and slippers.

Because of the good shock-absorbing and breathable properties of the volume nonwoven fabric contained therein, further garments which are particularly preferred according to the invention are those with shock-absorbing properties at particularly stressed locations, for example goalkeeper shorts, cycling shorts and riding breeches.

A further subject matter of the invention is a volume nonwoven fabric obtainable by the method according to the invention. The volume nonwoven fabrics according to the invention are distinguished by a particular structure and particular properties which are brought about by the particular production method. In particular, very light nonwoven fabrics can be produced which have exceptional stability. The nonwoven fabrics may further have very good thermal insulation properties and a high softness, high compressive resilience, good restoration capacity, good washability, a low weight, high insulation capacity and good adaptation to a body to be enveloped.

A further subject matter of the invention is a volume nonwoven fabric made of fiber balls and binder fibers, fibers or fiber bundles being drawn out of the fiber balls, the volume nonwoven fabric being thermally bonded and having a density in the range of 1 to 20 g/l. In this context, the fibers and fiber bundles are drawn out of the fiber balls non-uniformly and/or randomly. This volume nonwoven fabric too may have the further features described hereinafter.

The thickness of the volume nonwoven fabric may for example be between 0.5 and 500 mm, in particular from 1 to 200 mm or between 2 and 100 mm. The thickness of the volume nonwoven fabric is preferably selected as a function of the desired insulation effect and the materials used. Usually, good results are achieved with thicknesses (measured according to test specification EN 29073—T2:1992) in the range of 2 mm to 100 mm.

The surface weights of the volume nonwoven fabric according to the invention are set as a function of the desired application purpose. Surface weights, measured in accordance with DIN EN 29073:1992, in the range of 15 to 1500 g/m$^2$, preferably of 20 to 1200 g/m$^2$ and/or of 30 to 1000 g/m$^2$ and/or of 40 to 800 g/m$^2$ and/or of 50 to 500 g/m$^2$ have been found to be expedient for many applications.

In a preferred embodiment, the density of the volume nonwoven fabric is low. It is preferably less than 20 g/l, less than 15 g/l, less than 10 g/l or less than 7.5 g/l. The density may for example be in the range of 1 to 20 g/l, in particular of 2 to 15 g/l or of 3 to 10 g/l. For many applications of volume nonwoven fabrics, it is preferred for the density to be no more than 10 g/l, in particular no more than 8 g/l. The density is preferably calculated from the surface weight and the thickness. According to the invention, however, advantageous, particularly stable volume nonwoven fabrics having higher densities can also be produced.

Unlike the known products which contain volumizing materials, the volume nonwoven fabric according to the invention is distinguished by a high maximum tensile force. For example, the tensile strength can be set in such a way that the volume nonwoven fabric can be produced as a web material, processed further and used in a simple manner. In this case, the volume nonwoven fabric can be cut and rolled. In addition, it can be washed without loss of functionality.

The volume nonwoven fabric according to the invention is distinguished by a surprisingly adjustable stability. For many applications, it has been found to be advantageous if the volume nonwoven fabric has a high maximum tensile force, measured in accordance with DIN EN 29 073-3:1992 in the context of the present application. The maximum tensile force is generally identical in the longitudinal and transverse directions. Preferably, the values specified hereinafter apply to both the longitudinal and the transverse direction.

In a further embodiment, it is preferred for the volume nonwoven fabric to have a high stability. In this context, it preferably has a maximum tensile force of at least 2 N/5 cm, in particular of at least 4 N/5 cm or at least 5 N/5 cm.

The volume nonwoven fabric preferably has a maximum tensile strength of at least 0.3 N/5 cm, in particular of 0.3 N/5 cm to 100 N/5 cm, in at least one direction for a surface weight of 50 g/m$^2$.

In a preferred embodiment of the invention, the volume nonwoven fabric has a maximum tensile force of at least 0.3 N/5 cm, in particular of 0.3 N/5 cm to 100 N/5 cm, in at least one direction for a surface weight of 15 to 1500 g/m$^2$, preferably of 20 to 1200 g/m$^2$ and/or of 30 to 1000 g/m$^2$ and/or of 40 to 800 g/m$^2$ and/or of 50 to 500 g/m$^2$.

In a further preferred embodiment of the invention, the volume nonwoven fabric has a maximum tensile force (i) of at least 0.3 N/5 cm, in particular of 0.3 N/5 cm to 100 N/5 cm, in at least one direction for a surface weight of 15-50 g/m$^2$, (ii) of at least 0.4 N/5 cm, in particular of 0.4 N/5 cm to 100 N/5 cm, in at least one direction for a surface weight between 50 and 100 g/m$^2$, (iii) of at least 0.8 N/5 cm, in particular of 0.8 N/5 cm to 100 N/5 cm, in at least one direction for a surface weight of 100-150 g/m$^2$, (iv) of at least 1.2 N/5 cm, in particular of 1.2 N/5 cm to 100 N/5 cm, in at least one direction for a surface weight between 150 and 200 g/m$^2$, (v) of at least 1.6 N/5 cm, in particular of 1.6 N/5 cm to 100 N/5 cm, in at least one direction for a surface weight of 200 to 300 g/m$^2$, (vi) of at least 2.5 N/5 cm, in particular of 2.5 N/5 cm to 100 N/5 cm, in at least one direction for a surface weight of 300 to 500 g/m$^2$, (vii) of at least 4 N/5 cm, in particular of 4 N/5 cm to 100 N/5 cm, in at least one direction for a surface weight of 500 to 800 g/m$^2$, and (viii) of at least 6.5 N/5 cm, in particular of 6.5 N/5 cm to 100 N/5 cm, in at least one direction for a surface weight between 800 and 1500 g/m$^2$.

A further subject matter of the invention is volume nonwoven fabrics according to each individual scenario (i) to (viii).

The volume nonwoven fabric preferably has a maximum tensile force [N/5 cm]/thickness [mm] quotient of at least 0.10 [N/(5 cm*mm)], preferably at least 0.15 [N/(5 cm*mm)] or at least 0.18 [N/(5 cm*mm)]. In this context, the density is preferably no more than 10 g/l, in particular no more than 8 g/l. It is unusual for a low-density volume nonwoven fabric to have such a high maximum tensile force (for the thickness).

The volume nonwoven fabric preferably has a maximum tensile force [N/5 cm]/surface weight [g/m$^2$] quotient of at least 0.020 [N*m$^2$/(5 cm*g)], preferably at least 0.025 [N*m$^2$/(5 cm*g)] or at least 0.030 [N*m$^2$/(5 cm*g)]. In this context, the density is preferably no more than 10 g/l, in particular no more than 8 g/l. It is unusual for a volume nonwoven fabric to have such a high maximum tensile force for the surface weight.

The volume nonwoven fabric preferably has an extension at maximum tensile force of at least 20%, preferably at least 25% and in particular more than 30%, measured in accordance with DIN EN 29 073-3. In this context, the density is preferably no more than 10 g/1, in particular no more than 8 g/1.

The volume nonwoven fabric according to the invention is distinguished by good thermal insulation properties. Preferably, it has a thermal resistance ($R_{CT}$) of more than 0.10 (K*m$^2$)/W, more than 0.20 (K*m$^2$)/W or more than 0.30 (K*m$^2$)/W. In this context, the density is preferably no more than 10 g/l, in particular no more than 8 g/l. In the context of the present application, the thermal resistance is measured either in accordance with DIN 11092:2014-12 or by the method described hereinafter on the basis of DIN 52612:1979. It has been found that the results for the two methods are comparable. The method in accordance with DIN 11092:2014-12 is carried out using a thermoregulation model for human skin with $T_a$=20° C., $\varphi_a$=65% RH.

The volume nonwoven fabric preferably has a thermal resistance $R_{CT}$ [Km$^2$/W]/thickness [mm] quotient of at least 0.010 [Km$^2$/(W*mm)], preferably at least 0.015 [Km$^2$/(W*mm)]. In this context, the density is preferably no more than 10 g/l, in particular no more than 8 g/l. It is unusual for a low-density volume nonwoven fabric to achieve such a high $R_{CT}$ value (for the thickness).

The volume nonwoven fabric preferably has a thermal resistance $R_{CT}$ [Km$^2$/W]/surface weight [g/m$^2$] quotient of at least 0.0015 [Km$^4$/(W*g)], preferably at least 0.0020 [Km$^4$/(W*g)] or at least 0.0024 [Km$^4$/(W*g)]. In this context, the density is preferably no more than 10 g/l, in particular no more than 8 g/l. It is unusual for a volume nonwoven fabric to achieve such a high $R_{CT}$ for the surface weight.

According to the invention, a thermally insulating garment is understood to mean a garment containing a volume nonwoven fabric having a thermal resistance of at least 0.030 (K*m$^2$)/W, in particular of 0.030 to 7.000 (K*m$^2$)/W, for a surface weight of 15 to 1500 g/m$^2$, preferably of 20 to 1200 g/m$^2$ and/or of 30 to 1000 g/m$^2$ and/or of 40 to 800 g/m$^2$ and/or of 50 to 500 g/m$^2$.

Further, the volume nonwoven fabric has a thermal resistance of at least 0.030 (K*m$^2$)/W, in particular of 0.030 to 7.000 (K*m$^2$)/W, for a surface weight of 15 to 1500 g/m$^2$, preferably of 20 to 1200 g/m$^2$ and/or of 30 to 1000 g/m$^2$ and/or of 40 to 800 g/m$^2$ and/or of 50 to 500 g/m$^2$.

In a further preferred embodiment of the invention, the volume nonwoven fabric has a thermal resistance a. of at least 0.030 (K*m$^2$)/W, in particular of 0.030 to 0.235 (K*m$^2$)/W, for a surface weight of 15-50 g/m$^2$.
b. of at least 0.100 (K*m$^2$)/W, in particular of 0.100 to 0.470 (K*m$^2$)/W, for a surface weight between 50 and 100 g/m$^2$.
c. of at least 0.200 (K*m$^2$)/W, in particular of 0.200 to 0.705 (K*m$^2$)/W, for a surface weight of 100-150 g/m$^2$.
d. of at least 0.300 (K*m$^2$)/W, in particular of 0.300 to 0.940 (K*m$^2$)/W, for a surface weight between 150 and 200 g/m$^2$.
e. of at least 0.400 (K*m$^2$)/W, in particular of 0.400 to 1.410 (K*m$^2$)/W, for a surface weight of 200-300 g/m$^2$.
f. of at least 0.600 (K*m$^2$)/W, in particular of 0.600 to 2.350 (K*m$^2$)/W, for a surface weight between 300 and 500 g/m$^2$.
g. of at least 1.000 (K*m$^2$)/W, in particular of 1.000 to 3.760 (K*m$^2$)/W, for a surface weight of 500-800 g/m$^2$.
h. of at least 1.600 (K*m$^2$)/W, in particular of 1.600 to 7.000 (K*m$^2$)/W, for a surface weight between 800 and 1500 g/m$^2$.

A further subject matter of the invention is volume nonwoven fabrics according to each individual scenario (a.) to (h.)

In the embodiments of the present application, the thermal resistance ($R_{CT}$) has been measured on the basis of DIN 52612:1979 using a two-plate measurement appliance for samples having 250 mm×250 mm dimensions. In the center of the measurement installation there is a foil which can be heated using a constant electrical power P. The foil is covered both above and below with a specimen of the same material in each case. Above and below the specimen there is in each case a copper plate, which is kept at a constant temperature ($T_{external}$) by means of an external thermostat. Using a temperature sensor, the temperature difference between the heated and unheated faces of the sample is measured. The measurement installation as a whole is insulated against internal and external temperature losses using expanded polystyrene.

The thermal resistance is measured using the described measurement installation in the following manner.

1. Two specimens are punched out at 250 mm×250 mm.
2. The thickness of each of the two punched-out specimens is measured using a thickness sensor at 0.4 g contact pressure and an average is taken (d).
3. The above-described measurement installation is assembled and the thermostat is set to $T_{external}$=25° C. In this context, the distance between the two metal plates is set in such a way that the specimens are compressed by 10%, in such a way that sufficient contact of the specimens with the plates and the heatable film is provided.
4. A temperature difference ΔT is generated by heating the electrically heatable foil at a power P (P=10 V or 30 V) and keeping $T_{external}$ constant by means of a thermostat.
5. After thermal equilibrium is achieved, the temperature difference ΔT is taken.
6. The thermal conductivity of the material is calculated using the formula: $\lambda=P*d/(A*\Delta T)$ [W/(m*K)].
7. The thermal resistance ($R_{CT}$) is calculated using the formula: $R_{CT}=d/\lambda=\Delta T*A/P$ [(K*m$^2$)/W].

Further, the volume nonwoven fabric according to the invention advantageously has a high restoring force. Thus, the volume nonwoven fabric preferably has a recovery of more than 50, 60, 70, 80 or more than 90%, the recovery being measured in the following manner:

(1) 6 samples are stacked on top of one another (10×10 cm).
(2) The height is measured using a yardstick.
(3) The samples are weighted down using an iron plate (1300 g).
(4) After a minute of loading, the height is measured using a yardstick.
(5) The weight is removed.
(6) After 10 seconds, the height of the samples is measured using the yardstick.
(7) After one minute, the height of the samples is measured using the yardstick.
(8) The recovery is calculated by taking the ratio of the values from points 7 and 2.

5, 20 or 100 measurements are taken on different sample pieces, and the measurement values are averaged.

Because of its high stability, the volume nonwoven fabric, for example in the form of a web material, can be rolled up and further processed without difficulty.

Preferably, the volume nonwoven fabric has the following properties:

a density of no more than 10 g/l, in particular no more than 8 g/l, and
a maximum tensile force of at least 2 N/5 cm, and
a thermal resistance $R_{CT}$ of at least 0.20 Km$^2$/W, and
optionally a thermal resistance $R_{CT}$ [Km$^2$/W]/thickness [mm] quotient of at least 0.010 [Km$^2$/(W*mm)].

Particularly preferably, the volume nonwoven fabric has the following properties:

a maximum tensile force of at least 4 N/5 cm, measured in accordance with DIN EN 29 073-3,
a density of no more than 10 g/l, and
a maximum tensile force [N/5 cm]/thickness [mm] quotient of at least 0.10 [N/(5 cm*mm)], preferably at least 0.15 [N/(5 cm*mm)].

The embodiments show that volume nonwoven fabrics having this type of advantageous combination of low density and high strength can be produced by the method according to the invention.

In particular embodiments of the invention, a volume nonwoven fabric can be produced as follows.

120 g/m$^2$ of 35% by weight fiber balls of siliconized 7 dtex/32 mm PES (Dacron Polyester Fiberfill Type 287), to which 40% mPCM 28° C. PC temperature enthalpy is applied, 30% by weight fiber balls of CoPES binder fibers and 35% by weight downs and/or small feathers and feathers from Minardi are laid on a transport belt in a "SPIKE" air-laying system from Formfiber Denmark APS, which has four rows, arranged in two pairs, of five spiked rollers each for opening the fiber raw material, and bonded at 155° C. in a double-belt furnace from Bombi Meccania having a belt spacing of 10 mm. The dwell time is 36 seconds. A rollable web material is produced.

150 g/m$^2$ of 50% by weight wool fiber balls, 50% by weight fiber balls of CoPES binder fibers are laid on a transport belt in a "SPIKE" air-laying system from Formfiber Denmark APS, which has four rows, arranged in two pairs, of five spiked rollers each for opening the fiber raw material, and bonded at 155° C. in a double-belt furnace from Bombi Meccania having a belt spacing of 12 mm. The dwell time is 36 seconds. A rollable web material is obtained.

150 g/m$^2$ of 50% by weight silk fiber balls, 50% by weight fiber balls of CoPES binder fibers are laid on a transport belt in a "SPIKE" air-laying system from Formfiber Denmark APS, which has four rows, arranged in two pairs, of five spiked rollers each for opening the fiber raw material, and bonded at 155° C. in a double-belt furnace from Bombi Meccania having a belt spacing of 12 mm. The dwell time is 36 seconds. A rollable web material is obtained.

EMBODIMENTS

Various volume nonwoven fabrics have been produced and the properties have been determined. The thickness, density, surface weight, maximum tensile force, extension at maximum tensile force, recovery and thermal resistance ($R_{CT}$) were determined by the methods described above.

Embodiment 1

125 g/m$^2$ of 35% by weight fiber balls of siliconized 7 dtex/32 mm PES (Dacron Polyester Fiberfill Type 287), 30% by weight fiber balls of CoPES binder fibers and 35% by weight of a down/feather mixture in a 90:10 ratio from Minardi Piume S.r.l. are laid on a transport belt in a "SPIKE" air-laying system from Formfiber Denmark APS, which has four rows, arranged in two pairs, of five spiked rollers each for opening the fiber raw material, and bonded at 178° C. in a double-belt furnace from Bombi Meccania having a belt spacing of 14 mm. The dwell time was 43 seconds. A rollable web material having a thickness of 8 mm and a density of 15.2 g/l was obtained.

Embodiment 2

56 g/m$^2$ of 80% by weight fiber balls of siliconized 7 dtex/32 mm PES (Dacron Polyester Fiberfill Type 287) and 20% by weight CoPES binder fibers are laid on a transport belt in a "SPIKE" air-laying system from Formfiber Denmark APS, which has four rows, arranged in two pairs, of five spiked rollers each for opening the fiber raw material, and bonded at 170° C. in a double-belt furnace from Bombi Meccania having a belt spacing of 1 mm. A rollable web material having a thickness of 6.1 mm was obtained. The material had a density of 9.18 g/1.

Embodiment 3

128 g/m$^2$ of 80% by weight fiber balls of siliconized 7 dtex/32 mm PES (Dacron Polyester Fiberfill Type 287) and 20% by weight CoPES binder fibers are laid on a transport belt in a "SPIKE" air-laying system from Formfiber Denmark APS, which has four rows, arranged in two pairs, of five spiked rollers each for opening the fiber raw material, and bonded at 170° C. in a double-belt furnace from Bombi Meccania having a belt spacing of 4 mm. A rollable web material having a thickness of 7.5 mm was obtained. The material had a density of 17.07 g/l.

Embodiment 4

128 g/m$^2$ of 80% by weight fiber balls of siliconized 7 dtex/32 mm PES (Dacron Polyester Fiberfill Type 287) and 20% by weight CoPES binder fibers are laid on a transport belt in a "SPIKE" air-laying system from Formfiber Denmark APS, which has four rows, arranged in two pairs, of five spiked rollers each for opening the fiber raw material, and bonded at 170° C. in a double-belt furnace from Bombi Meccania having a belt spacing of 30 mm, in other words without a load on the fiber web. A soft, rollable web material having a thickness of 25 mm was obtained. The material had a density of 5.12 g/1.

Embodiment 5

723 g/m$^2$ of 80% by weight fiber balls of siliconized 7 dtex/32 mm PES (Dacron Polyester Fiberfill Type 287) and 20% by weight CoPES binder fibers are laid on a transport belt in a "SPIKE" air-laying system from Formfiber Denmark APS, which has four rows, arranged in two pairs, of five spiked rollers each for opening the fiber raw material, and bonded at 170° C. in a double-belt furnace from Bombi Meccania having a belt spacing of 50 mm. A rollable, stable web material having a thickness of 50 mm was obtained. The material had a density of 14.5 g/l.

Embodiment 6

112 g/m$^2$ of 85% by weight fiber balls (MICROROLLO® 222 SM from A. Molina & C.) and 15% by weight PET/PE binder fibers are laid on a transport belt in a "SPIKE" air-laying system from Formfiber Denmark APS, which has four rows, arranged in two pairs, of five spiked rollers each for opening the fiber raw material, and bonded at 180° C. in a double-belt furnace from Bombi Meccania having a belt spacing of 40 mm. A rollable, stable web material having a thickness of 17 mm was obtained. The material had a density of 6.5 g/l, a maximum tensile force of 3.84 N/5 cm and an extension at maximum tensile force of 29%, and an $R_{CT}$ value of 0.323 Km$^2$/W (at P=10 V).

Embodiment 7

151 g/m$^2$ of 85% by weight fiber balls (MICROROLLO® 222 SM from A. Molina & C.) and 15% by weight PET/PE binder fibers are laid on a transport belt in a "SPIKE" air-laying system from Formfiber Denmark APS, which has four rows, arranged in two pairs, of five spiked rollers each for opening the fiber raw material, and bonded at 180° C. in a double-belt furnace from Bombi Meccania having a belt spacing of 40 mm. A rollable, stable web material having a thickness of 19 mm was obtained. The material had a density of 6.1 g/l. A specimen of 167 g/m$^2$, taken at another point, had a maximum tensile force of 5.14 N/5 cm and an extension at maximum tensile force of 33% and an $R_{CT}$ value of 0.398 Km$^2$/W (at P=10 V).

Embodiment 8

218 g/m$^2$ of 85% by weight fiber balls (MICROROLLO® 222 SM from A. Molina & C.) and 15% by weight PET/PE binder fibers are laid on a transport belt in a "SPIKE" air-laying system from Formfiber Denmark APS, which has four rows, arranged in two pairs, of five spiked rollers each for opening the fiber raw material, and bonded at 180° C. in a double-belt furnace from Bombi Meccania having a belt spacing of 50 mm. A rollable, stable web material having a thickness of 31 mm was obtained. The material had a density of 7.0 g/l. A specimen of 259 g/m$^2$, taken at another point, had a maximum tensile force of 5.45 N/5 cm and an extension at maximum tensile force of 34% and an $R_{CT}$ value of 0.534 $Km^2/W$ (at P=10 V).

Embodiment 9

Further properties of the nonwoven fabrics produced in accordance with the examples were analyzed. The results are summarized in Table 1. For comparison, the densities of the nonwoven fabric balls are given in Table 2. The comparison shows that according to the invention products can readily be obtained having a much lower density than the nonwoven fabric balls used, even although the density of the binder fibers is much higher. Therefore, particularly light volume nonwoven fabrics can be produced, which nevertheless have exceptionally high surface weights. The volume nonwoven fabrics also have very good recovery values, this being of great importance for textile applications.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

TABLE 2

Properties of the nonwoven fabric balls used:

| Raw materials | Volume [ml] | Weight [g] | Density [g/l] |
|---|---|---|---|
| Dacron Polyester Fiberfill Type 287 | 500 | 5.795 | 11.59 |
| Microrollo 222 SM | 500 | 6.518 | 13.04 |

The invention claimed is:

1. A method for producing a volume nonwoven fabric, comprising the steps of:

(a) providing a nonwoven fabric raw material, containing fiber balls and binder fibers;

(b) providing an air-laying device, which has at least two spiked rollers between which a gap is formed;

(c) processing the nonwoven fabric raw material in the device in an air-laying method, the nonwoven fabric raw material passing through the gap between the spiked rollers, fibers or fiber bundles being pulled from the fiber balls by the spikes;

(d) laying on a laying apparatus; and (e) thermally bonding so as to obtain the volume nonwoven fabric, the obtained nonwoven fabric comprises:
the fiber balls; and
the binder fibers,
wherein the fibers or the fiber bundles are drawn out of the fiber balls, and
wherein the volume nonwoven fabric is thermally bonded and not needled and has a density in the range of 1 to 20 g/l.

2. The method according to claim 1, wherein the device has at least two pairs of spiked rollers, and/or wherein the device has at least 2 gaps between the spiked rollers.

3. The method according to claim 1, wherein a proportion of fiber balls is 50 to 95% by weight, and/or wherein a proportion of binder fibers in the volume nonwoven fabric is 5 to 40% by weight, in each case based on a total weight of the nonwoven fabric raw material.

4. The method according claim 1, wherein the fiber balls comprise fibers selected from artificial polymers and natural fibers, and/or mixtures thereof and/or mixtures with other fibers.

5. The method according to claim 1, wherein the binder fibers comprise core/sheath fibers, the sheath comprising polyethylene, polypropylene, polybutylene terephthalate, polyamide, copolyamides or copolyester, and/or the core comprising polyethylene terephthalate, polyethylene naphthalate, polyolefins, polyphenylene sulphide, aromatic polyamides and/or polyester.

TABLE 1

Density of the volume nonwoven fabrics (Ex. = example, SW = surface weight, MTF = maximum tensile force, EMTF = extension at maximum tensile force, Rec. = recovery, $R_{CT}$ = thermal resistance, measured at P = 10 V):

| Ex. | Thickness [mm] | SW [$g/m^2$] | Density [g/l] | MTF [N/5 cm] | EMTF [%] | Rec. [%] | $R_{CT}$ [$Km^2/W$] | MTF/Thickness [N/(5 cm*mm)] | MTF/SW [$N*m^2/(5\ cm*g)$] | $R_{CT}$/Thickness [$Km^2/(W*mm)$] | $R_{CT}$/SW [$Km^4/(W*g)$] |
|---|---|---|---|---|---|---|---|---|---|---|---|
| 1 | 8 | 125 | 15.2 | | | 89.5 | | | | | |
| 2 | 6.1 | 56 | 9.2 | | | | | | | | |
| 3 | 7.5 | 128 | 17.1 | | | | | | | | |
| 4 | 25 | 128 | 5.1 | | | | | | | | |
| 5 | 50 | 723 | 14.5 | | | | | | | | |
| 6 | 17 | 112 | 6.5 | 3.84 | 29 | 82% | 0.323 | 0.22 | 0.034 | 0.019 | 0.0029 |
| 7 | 19 | 151 | 6.1 | 5.14 | 33 | 84% | 0.398 | 0.27 | 0.034 | 0.021 | 0.0026 |
| 8 | 31 | 218 | 7.0 | 5.45 | 34 | 76% | 0.534 | 0.18 | 0.025 | 0.017 | 0.0024 |

6. The method according to claim 1, wherein the nonwoven fabric raw material contains at least one further component, selected from further fibers, further volumizing materials, and other functional additives.

7. The method according to claim 1, wherein a density of the volume nonwoven fabric is at least 5% lower than a density of the nonwoven fabric balls used in step (a).

8. A method for producing a textile material, comprising producing a volume nonwoven fabric according to the method of claim 1, and further processing to form the textile material, the textile material being selected from garments, molding materials, cushion materials, padding materials, bedding, filter mats, suction mats, cleaning textiles, spacers, foam substitute, wound dressings, and fire protection materials.

9. A volume nonwoven fabric, obtainable by the method of claim 1.

10. The volume nonwoven fabric according to claim 9, having at least one of the following properties:

a maximum tensile force of at least 2 N/5 cm, measured in accordance with DIN EN 29 073-3;

an extension at maximum tensile force of at least 20%, measured in accordance with DIN EN 29 073-3;

a thermal resistance $R_{CT}$ of at least 0.20 $Km^2/W$; and a recovery of at least 70%, determined by the method the following steps:

(1) 6 samples are stacked on top of one another (10×10 cm);

(2) a height of the stack is measured using a yardstick;

(3) the samples are weighted down using an iron plate (1300 g);

(4) after a minute of loading, the height is measured using a yardstick;

(5) the weight is removed;

(6) after 10 seconds, the height of the samples is measured using the yardstick;

(7) after one minute, the height of the samples is measured using the yardstick;

(8) the recovery is calculated by taking the ratio of the values from points 7 and 2.

11. The volume nonwoven fabric according to claim 9, having the following properties:

a maximum tensile force [N/5 cm]/thickness [mm] quotient of at least 0.10 [N/(5 cm*mm)]; and/or a maximum tensile force [N/5 cm]/surface weight [$g/m^2$] quotient of at least 0.020 [$N*m^2/(5\ cm*g)$]; and/or a thermal resistance $R_{CT}$ [$Km^2/W$]/thickness [mm] quotient of at least 0.010 [$Km^2/(W*mm)$].

12. The volume nonwoven fabric according to claim 9, having the following properties:

a density of less than 10 g/l; and a maximum tensile force of at least 2 N/5 cm; and a thermal resistance $R_{CT}$ of at least 0.20 $Km^2/W$; and optionally a thermal resistance $R_{CT}$ [$Km^2/W$]/thickness [mm] quotient of at least 0.010 [$Km^2/(W*mm)$].

13. The volume nonwoven fabric according to claim 9, having the following properties:

a maximum tensile force of at least 4 N/5 cm, measured in accordance with DIN EN 29 073-3;

a density of no more than 10 g/l; and a maximum tensile force [N/5 cm]/thickness [mm] quotient of at least 0.10 [N/(5 cm*mm)].

14. A volume nonwoven fabric comprising:

fiber balls; and binder fibers, wherein fibers or fiber bundles are drawn out of the fiber balls, and wherein the volume nonwoven fabric is thermally bonded and not needled and has a density in the range of 1 to 20 g/l.

15. A textile material, containing the volume nonwoven fabric according to claim 14, wherein the textile material is selected from garments, molding materials, cushion materials, padding materials, bedding, filter mats, suction mats, cleaning textiles, spacers, foam substitute, wound dressings, and fire protection materials.

16. A method of producing a textile material, the method comprising:

processing the volume nonwoven fabric according to claim 14 to produce a textile material, wherein the textile material is selected from garments, molding materials, cushion materials, padding materials, bedding, filter mats, suction mats, cleaning textiles, spacers, foam substitute, wound dressings, and fire protection materials.

17. The method according to claim 2, wherein the at least two pairs of spiked rollers comprises at least 5 pairs or at least 10 pairs.

18. The method according to claim 17, wherein the at least two pairs of spiked rollers comprises at least 10 pairs.

19. The method according to claim 17, wherein the device has at least 5 gaps between the spiked rollers.

20. The volume nonwoven fabric of claim 14, wherein the fibers or fiber bundles are drawn out of the fiber balls by at least two pairs of spiked rollers.

21. The volume nonwoven fabric of claim 14, which has a maximum tensile force of at least 2 N/5 cm, measured in accordance with DIN EN 29 073-3.

22. The volume nonwoven fabric of claim 14, wherein the volume of nonwoven fabric is produced according to the following process:

(a) providing a nonwoven fabric raw material, comprising the fiber balls and the binder fibers; and (b) processing the nonwoven fabric raw material using an air-laying method, wherein the nonwoven fabric raw material passes through a gap between spiked rollers to pull the fibers or the fiber bundles from the fiber balls.

* * * * *